US008702406B2

(12) United States Patent
Reinhart et al.

(10) Patent No.: US 8,702,406 B2
(45) Date of Patent: Apr. 22, 2014

(54) COMPRESSOR ALIGNMENT METHOD AND DEVICE

(75) Inventors: Keith J. Reinhart, Sidney, OH (US); Gary J. Diller, Coldwater, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 13/440,315

(22) Filed: Apr. 5, 2012

(65) Prior Publication Data

US 2012/0255174 A1 Oct. 11, 2012

Related U.S. Application Data

(60) Provisional application No. 61/472,259, filed on Apr. 6, 2011.

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.
USPC ..... 418/1; 418/55.1; 418/55.5; 418/57; 464/158

(58) Field of Classification Search
USPC ..... 418/55.1–55.6, 57, 1; 464/158
See application file for complete search history.

(56) References Cited

U.S. PATENT DOCUMENTS

| | | | | |
|---|---|---|---|---|
| 5,407,335 A * | 4/1995 | Caillat et al. | ..... | 418/55.1 |
| 5,551,851 A * | 9/1996 | Williams et al. | ..... | 418/55.1 |
| 7,043,817 B2 * | 5/2006 | Powell et al. | ..... | 29/888.022 |

* cited by examiner

*Primary Examiner* — Theresa Trieu
(74) *Attorney, Agent, or Firm* — Harness, Dickey & Pierce, P.L.C.

(57) ABSTRACT

A compressor assembly method may include locating a first scroll member on a bearing housing of a compressor having a second scroll member located axially between the first scroll member and the bearing housing. A first outer radial surface on the bearing housing and a second outer radial surface on the first scroll member with an alignment assembly may be engaged to concentrically align the bearing housing and the first scroll member. The first scroll member may be coupled relative to the bearing housing.

16 Claims, 17 Drawing Sheets

COMPRESSOR ALIGNMENT METHOD AND DEVICE

CROSS-REFERENCE TO RELATED APPLICATIONS

This application claims the benefit of U.S. Provisional Application No. 61/472,259, filed on Apr. 6, 2011. The entire disclosure of the above application is incorporated herein by reference.

FIELD

The present disclosure relates to a method and device for aligning compressor components.

BACKGROUND

This section provides background information related to the present disclosure which is not necessarily prior art.

A scroll compressor typically includes a drive shaft that drives a compression mechanism and a main bearing housing supporting the drive shaft within a shell assembly. The compression mechanism includes an orbiting scroll, a non-orbiting scroll, and an Oldham coupling. The Oldham coupling prevents relative rotation between the orbiting scroll and the non-orbiting scroll.

A scroll assembly method typically includes concentrically aligning the non-orbiting scroll relative to the main bearing housing. In addition, the non-orbiting scroll is rotationally fixed relative to the main bearing housing. Fasteners and bushings are then installed between the non-orbiting scroll and the main bearing housing to maintain concentric alignment and rotational fixation between the non-orbiting scroll and the main bearing housing.

SUMMARY

This section provides a general summary of the disclosure, and is not a comprehensive disclosure of its full scope or all of its features.

A compressor assembly method may include locating a first scroll member on a bearing housing of a compressor with a second scroll member located axially between the first scroll member and the bearing housing. A first outer radial surface on the bearing housing and a second outer radial surface on the first scroll member may be engaged with an alignment assembly to concentrically align the bearing housing and the first scroll member. The first scroll member may be coupled relative to the bearing housing.

The alignment assembly may include a rotational stop member and the engaging may include rotationally fixing the first scroll member relative to the bearing housing with the rotational stop member. The engaging may include aligning a first set of apertures in the first scroll member with a second set of apertures in the bearing housing and the coupling may include simultaneously installing fasteners into each of the apertures.

The method may additionally include aligning a first aperture in the first scroll member and a second aperture in the bearing housing with an alignment pin to rotationally locate the first scroll member relative to the bearing housing. The aligning may include using a single alignment pin.

The alignment assembly may include a first threaded portion and a second threaded portion and the engaging may include rotating the first threaded portion relative to the second threaded portion to engage at least one of the first and second outer radial surfaces. The method may additionally include locating the alignment assembly on an axial end surface of the first scroll member to axially locate the alignment assembly relative to the first scroll member.

The alignment assembly may include a biasing mechanism and the engaging may include the biasing mechanism applying a force in a radial direction on the first and second outer radial surfaces. The biasing mechanism may include first and second biasing members and the engaging may include the first biasing member engaging the first outer radial surface and the second biasing member engaging the second outer radial surface.

The alignment assembly may include a tapered inner surface and the engaging may include the tapered inner surface engaging at least one of the first and second outer radial surfaces to provide concentric alignment between the first scroll member and the bearing housing.

The alignment assembly may include a first member having axially extending first flexible arms adjacent to the second outer radial surface on the first scroll member and a second member defining a first ramped surface located radially outward relative to the first flexible arms. The concentrically aligning may include the first ramped surface displacing the first flexible arms radially inward and into engagement with the second outer radial surface on the first scroll member. The first member may include a first annular wall located radially outward from the first flexible arms and defining a first threaded inner surface. The second member may define a first threaded outer surface engaged with the first threaded inner surface and the concentrically aligning may include rotating the second member relative to the first member to displace the first flexible arms. The first member may include axially extending second flexible arms extending opposite the first flexible arms and adjacent to the first outer radial surface on the bearing housing.

The alignment assembly may include a third member defining a second ramped surface located radially outward relative to the second flexible arms and the concentrically aligning may include the second ramped surface displacing the second flexible arms radially inward and into engagement with the first outer radial surface on the bearing housing. The method may additionally include locating the third member on an end of a compressor shell containing the bearing housing. The third member may include a second annular wall located radially outward from the second flexible arms and defining a second threaded inner surface. The second member may define a second threaded outer surface engaged with the second threaded inner surface and the concentrically aligning may include rotating the first member relative to the third member to displace the second flexible arms.

The method may additionally include locating the first member on an end of a compressor shell containing the bearing housing.

A scroll alignment assembly may include an axial alignment portion and a concentric alignment portion. The axial alignment portion may overlie and abut an axial end surface of a first scroll member of a compressor to axially locate the scroll alignment assembly relative to the first scroll member. The concentric alignment portion may extend axially from the axial alignment portion and abut a first outer radial surface on the first scroll member and a second outer radial surface on a bearing housing supporting the first scroll member to concentrically align the first scroll member relative to the bearing housing.

The axial alignment portion may extend radially inward relative to an inner radial wall of the concentric alignment portion. The concentric alignment portion may form an annular body. The axial alignment portion may include a recess extending into an inner radial wall thereof providing clearance for insertion of a fastener to couple the first scroll member to the bearing housing. The scroll alignment assembly may additionally include a rotational stop member extending axially from the axial alignment portion. The rotational stop member may abut the first outer radial surface and the second outer radial surface to prevent the first scroll member from rotating relative to the bearing housing.

An alternate scroll alignment assembly may include a concentric alignment member and a biasing mechanism. The concentric alignment member may surround a first outer radial surface on a first scroll member and a second outer radial surface on a bearing housing supporting the first scroll member. The biasing mechanism may extend radially inward relative to an inner radial wall of the concentric alignment member and abut the first and second outer radial surfaces to concentrically align the first scroll member relative to the bearing housing.

The biasing mechanism may include first and second biasing members. The first biasing member may abut the first outer radial surface and the second biasing member may abut the second outer radial surface.

An alternate scroll alignment assembly may include an outer concentric alignment member and an inner concentric alignment member. The outer concentric alignment member may surround a first outer radial surface on a first scroll member and a second outer radial surface on a bearing housing supporting the first scroll member. The inner concentric alignment member may extend radially inward relative to an inner radial wall of the outer concentric alignment member and abut the first and second outer radial surfaces to concentrically align the first scroll member relative to the bearing housing.

An alternate scroll alignment assembly may include a first concentric alignment assembly and a second concentric alignment assembly. The first concentric alignment assembly may abut a first outer radial surface on a first scroll member. The second concentric alignment assembly may abut a second outer radial surface on a bearing housing and support the first scroll member. The first concentric alignment assembly may have a first radial wall that includes a first threaded portion engaging a second threaded portion of a second radial wall of the second concentric alignment assembly.

An alternate scroll alignment assembly may include a first concentric alignment assembly and a second concentric alignment assembly. The first concentric alignment assembly may surround a first outer radial surface on a first scroll member and abut a second outer radial surface on a bearing housing supporting the first scroll member. The second concentric alignment assembly may include an outer radial surface abutting the first concentric alignment assembly and a tapered inner radial surface abutting the first outer radial surface.

An alternate scroll alignment assembly may include a first member and a second member. The first member may surround a first outer radial surface on a bearing housing and a second outer radial surface on a first scroll member. The first member may include axially extending first flexible arms adjacent to the second outer radial surface on the first scroll member. The second member may be engaged with said first member and define a first ramped surface located radially outward relative to and engaged with the first flexible arms to displace the first flexible arms radially inward and concentrically align the first scroll member relative to the bearing housing.

The first member may include a first annular wall located radially outward from the first flexible arms and defining a first threaded inner surface. The second member may define a first threaded outer surface engaged with the first threaded inner surface and the second member may be rotatable relative to the first member to displace the first flexible arms. The first member may include axially extending second flexible arms extending opposite the first flexible arms and adjacent to the first outer radial surface on the bearing housing. The scroll alignment assembly may further include a third member defining a second ramped surface located radially outward relative to and engaged with the second flexible arms to displace the second flexible arms radially inward and into engagement with the first outer radial surface on the bearing housing.

The third member may be located on an end of a compressor shell containing the bearing housing. The third member may include a second annular wall located radially outward from the second flexible arms and defining a second threaded inner surface. The third member may define a second threaded outer surface engaged with the second threaded inner surface. The third member may be rotatable relative to the first member to displace the second flexible arms radially inward and into engagement with the first outer radial surface on the bearing housing.

The first member may be located on an end of a compressor shell containing the bearing housing.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present teachings are suitable for incorporation in many different types of scroll and rotary compressors, including hermetic machines, open drive machines and non-hermetic machines. For exemplary purposes, a compressor assembly 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
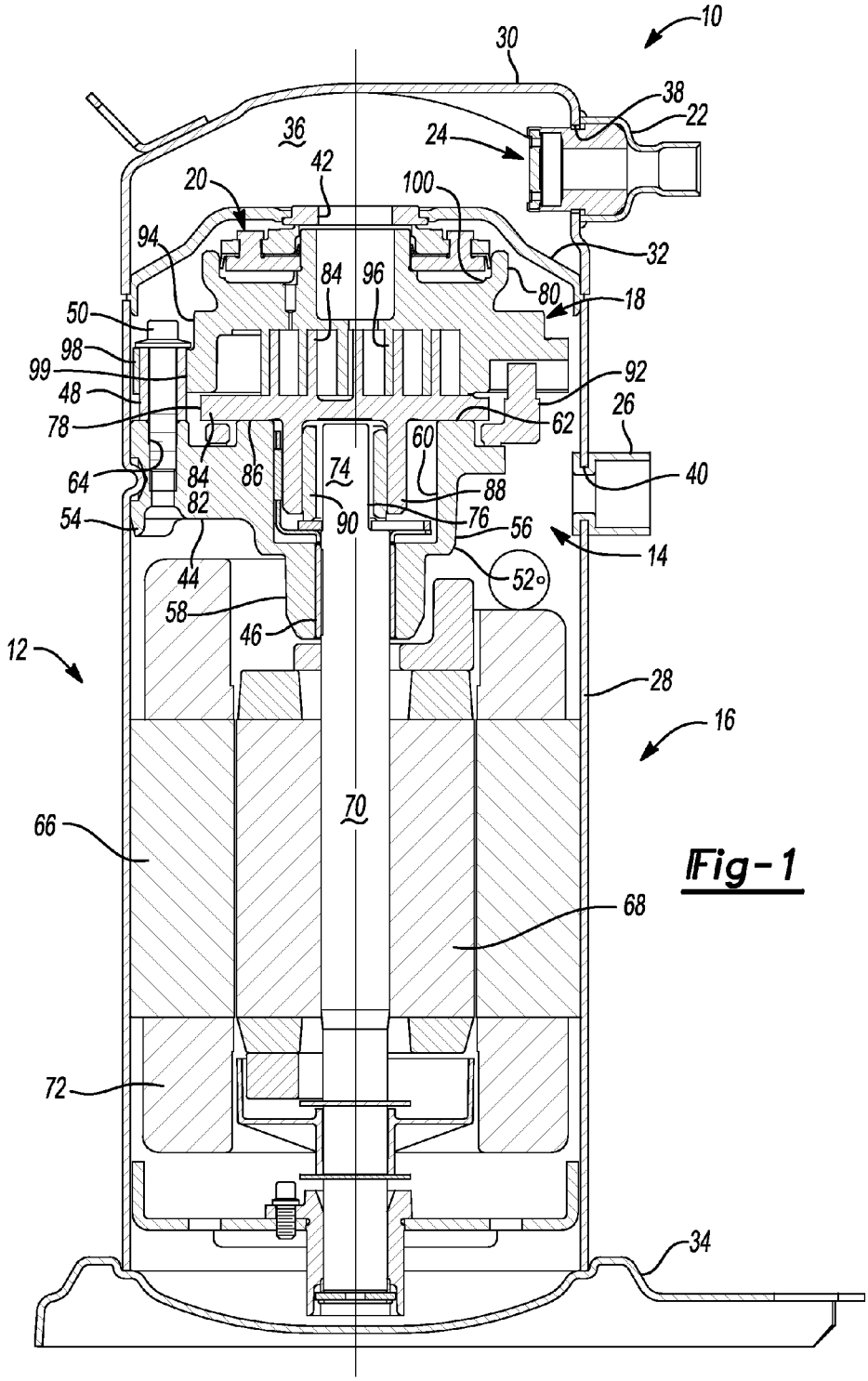
FIG. 1 is a section view of a compressor according to the present disclosure.

With reference to FIG. 1, compressor assembly 10 may include a hermetic shell assembly 12, a main bearing housing assembly 14, a motor assembly 16, a compression mechanism 18, a seal assembly 20, a refrigerant discharge fitting 22, a discharge valve assembly 24, and a suction gas inlet fitting 26. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor assembly 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 42 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 44, a first bearing 46 disposed therein, bushings 48, and fasteners 50. Main bearing housing 44 may include a central body portion 52 having a series of arms 54 extending radially outwardly therefrom. Central body portion 52 may include first and second portions 56, 58 having an opening 60 extending therethrough. Second portion 58 may house first bearing 46 therein. First portion 56 may define an annular flat thrust bearing surface 62 on an axial end surface thereof. Arms 54 may include apertures 64 extending therethrough and receiving fasteners 50.

Motor assembly 16 may generally include a motor stator 66, a rotor 68, and a drive shaft 70. Windings 72 may pass through stator 66. Motor stator 66 may be press fit into shell 28. Drive shaft 70 may be rotatably driven by rotor 68. Rotor 68 may be press fit on drive shaft 70. Drive shaft 70 may include an eccentric crank pin 74 having a flat 76 thereon.

Compression mechanism 18 may generally include an orbiting scroll 78 and a non-orbiting scroll 80. Orbiting scroll 78 may include an end plate 82 having a spiral vane or wrap 84 on the upper surface thereof and an annular flat thrust surface 86 on the lower surface. Thrust surface 86 may interface with annular flat thrust bearing surface 62 on main bearing housing 44. A cylindrical hub 88 may project downwardly from thrust surface 86 and may have a drive bushing 90 rotatively disposed therein. Drive bushing 90 may include an inner bore in which crank pin 74 is drivingly disposed. Crank pin flat 76 may drivingly engage a flat surface in a portion of the inner bore of drive bushing 90 to provide a radially compliant driving arrangement. An Oldham coupling 92 may be engaged with the orbiting and non-orbiting scrolls 78, 80 to prevent relative rotation therebetween.

Non-orbiting scroll 80 may include an end plate 94 having a spiral wrap 96 on a lower surface thereof and a series of radially outwardly extending flanged portions 98. The radially outwardly extending flanged portions 98 may include apertures 99 extending therethrough and receiving fasteners 50. Spiral wrap 96 may form a meshing engagement with wrap 84 of orbiting scroll 78, thereby creating a series of pockets. The pockets created by spiral wraps 84, 96 may change throughout a compression cycle of compression mechanism 18.

Seal assembly 20 may include a floating seal located within a first annular recess 100. Seal assembly 20 may be axially displaceable relative to shell assembly 12 and non-orbiting scroll 80 to provide for axial displacement of non-orbiting scroll 80 while maintaining a sealed engagement with partition 32 to isolate discharge and suction pressure regions of compressor assembly 10 from one another. More specifically, pressure within first annular recess 100 may urge seal assembly 20 into engagement with partition 32 during normal compressor operation.

A typical compressor alignment method and device utilizes alignment pins to concentrically align and rotationally fix non-orbiting scroll 80 relative to main bearing housing 44. Before concentrically aligning and rotationally fixing non-orbiting scroll 80, main bearing housing 44 is affixed to shell 28. Then, alignment pins are inserted in apertures 99 of non-orbiting scroll 80 and apertures 64 of main bearing housing 44, apertures 64 including dimensionally-controlled counter bores to position alignment pins accurately. Next, some alignment pins are removed so that some fasteners 50 may be assembled in apertures 99 and apertures 64. Finally, all remaining alignment pins are removed so that all remaining fasteners 50 may be assembled to couple main bearing housing 44 and non-orbiting scroll 80.

The compressor alignment method and device of the present disclosure engages outer radial surfaces of main bearing housing 44 and non-orbiting scroll 80 to concentrically align non-orbiting scroll 80 relative to main bearing housing 44. In addition, the compressor alignment method and device of the present disclosure may abut outer radial surfaces of main bearing housing 44 and non-orbiting scroll 80 to rotationally fix non-orbiting scroll 80 relative to main bearing housing 44. While concentrically aligning and rotationally fixing non-orbiting scroll 80 are mainly discussed, the concepts discussed herein apply equally to concentrically aligning and rotationally fixing an orbiting scroll.

Non-orbiting scroll 80 may be concentrically aligned and rotationally fixed relative to main bearing housing 44 utilizing a single alignment pin 116 in apertures 99 of non-orbiting scroll 80 and apertures 64 of main bearing housing 44 in the arrangements shown in FIGS. 2-16, 21 and 22 discussed below. Concentric alignment of non-orbiting scroll 80 relative to main bearing housing 44 may reduce the number of dimensional tolerances to be controlled relative to traditional assembly methods. Additionally, multiple fasteners 50 may be assembled in a single operation, reducing assembly time.

Figure 2:
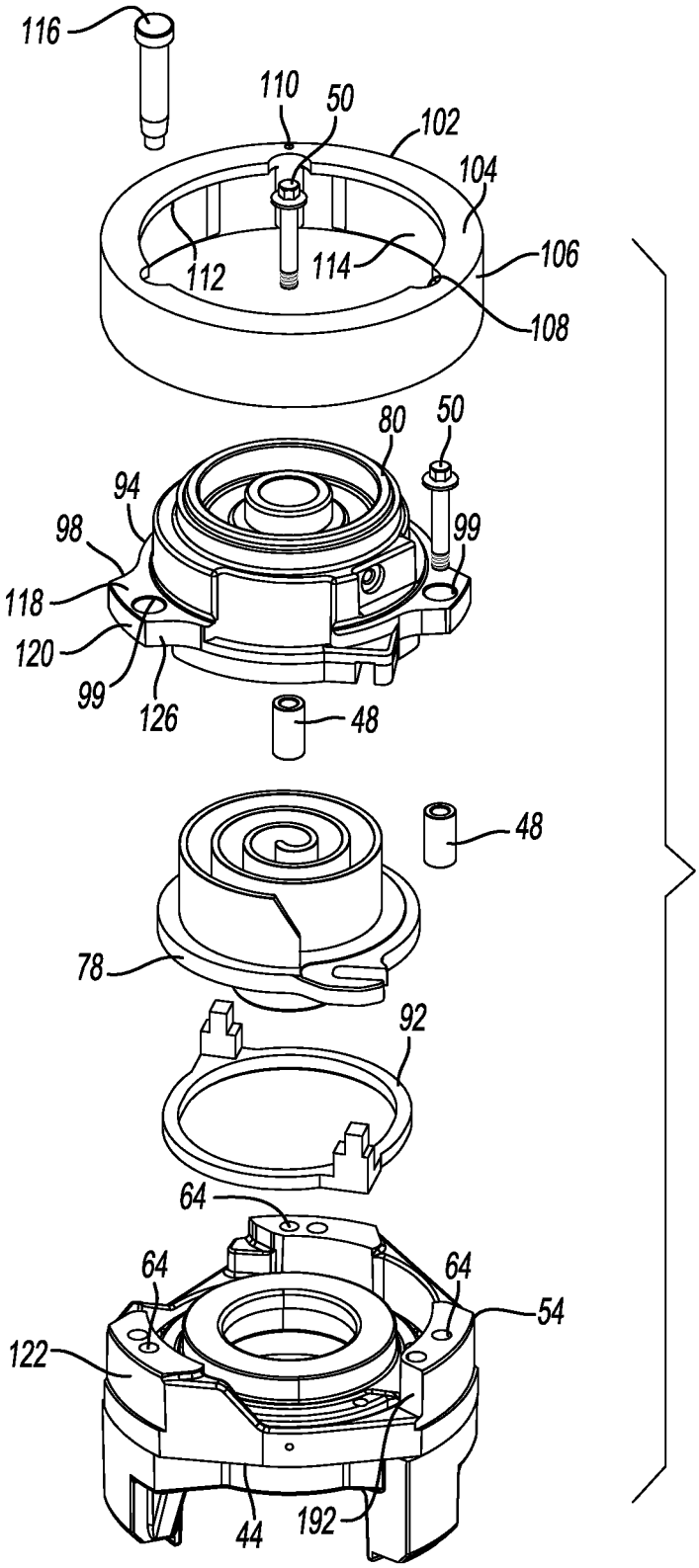
FIG. 2 is an exploded isometric view of a main bearing housing assembly, a compression mechanism, and an alignment assembly according to the present disclosure.
Figure 3:
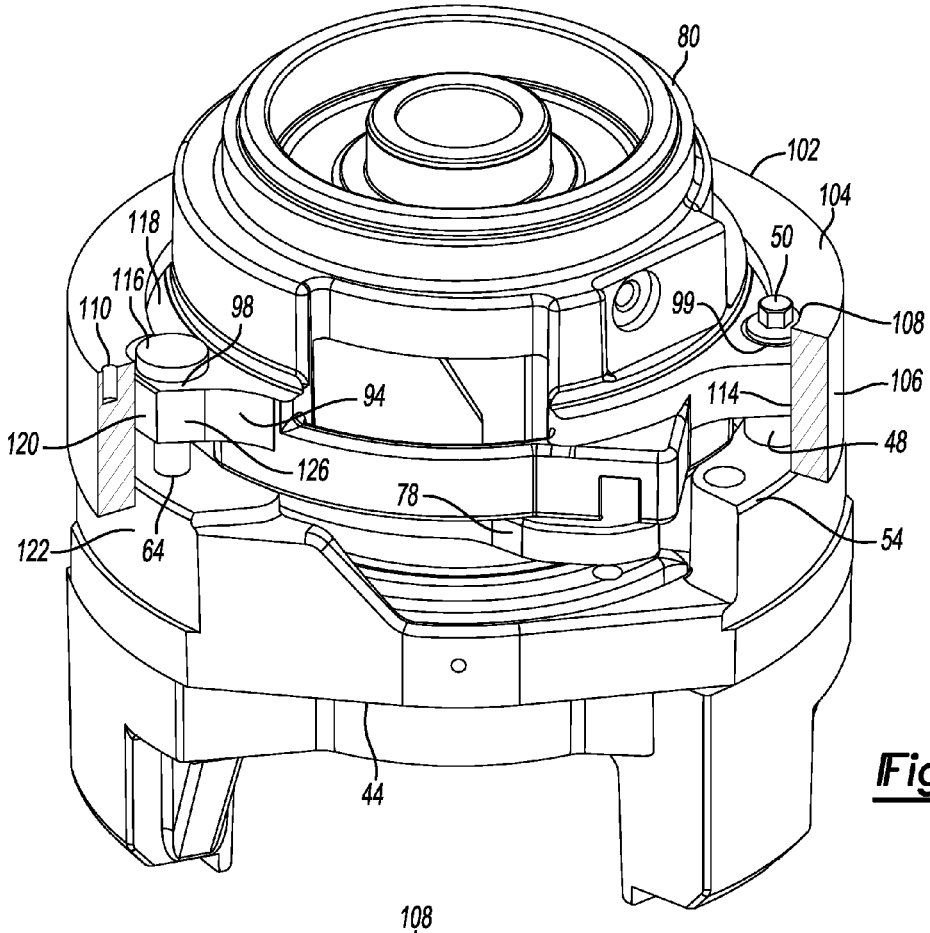
FIG. 3 is an isometric view of a main bearing housing assembly assembled to a compression mechanism and a sectioned isometric view of an alignment assembly according to the present disclosure.
Figure 4:
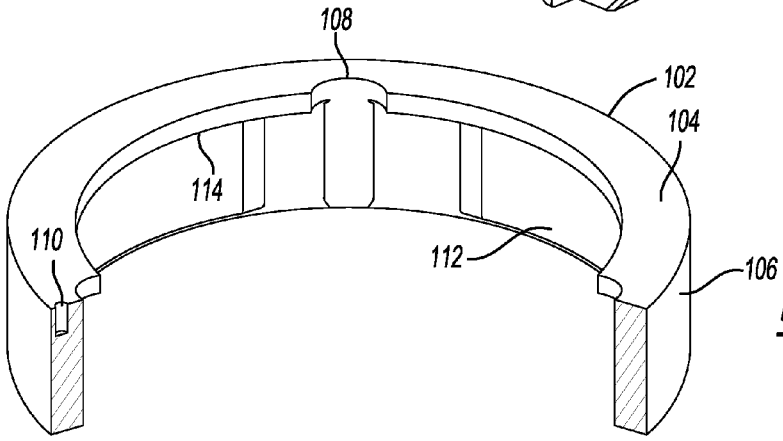
FIG. 4 is a sectioned isometric view of an alignment assembly according to the present disclosure.

With reference to FIGS. 2-4, in a first arrangement, a scroll alignment member 102 may concentrically align non-orbiting scroll 80 relative to main bearing housing 44. Scroll alignment member 102 includes an axial alignment portion 104 and a concentric alignment portion 106. Axial alignment portion 104 may form a flat annular body. Concentric alignment portion 106 may form a generally annular body and extend axially downward from axial alignment portion 104. Axial alignment portion 104 may include recesses 108, an aperture 110, and an axial end surface 112 at a lower end thereof. Recesses 108 may extend into an inner radial wall of axial alignment portion 104 to provide clearance for insertion of fasteners 50 to couple non-orbiting scroll 80 to main bearing housing 44. Concentric alignment portion 106 may include an inner radial surface 114.

Non-orbiting scroll 80 may be supported by main bearing housing 44 affixed to shell 28, with orbiting scroll 78 and Oldham coupling 92 located axially between main bearing housing 44 and non-orbiting scroll 80. Bushings 48 may be inserted in apertures 99 within end plate 94 of non-orbiting scroll 80. Axial alignment portion 104 may overlie and abut axial end surfaces 118 on end plate 94 of non-orbiting scroll 80 to axially locate scroll alignment member 102. Concentric alignment portion 106 may abut outer radial surfaces 120 on flanged portions 98 of non-orbiting scroll 80 and abut outer radial surfaces 122 on arms 54 of main bearing housing 44 to concentrically align non-orbiting scroll 80 relative to main bearing housing 44. Outer radial surfaces 126 on flanged portions 98 may be utilized to rotationally fix non-orbiting scroll 80 relative to main bearing housing 44, as discussed below in reference to FIGS. 17-20.

Figure 5:
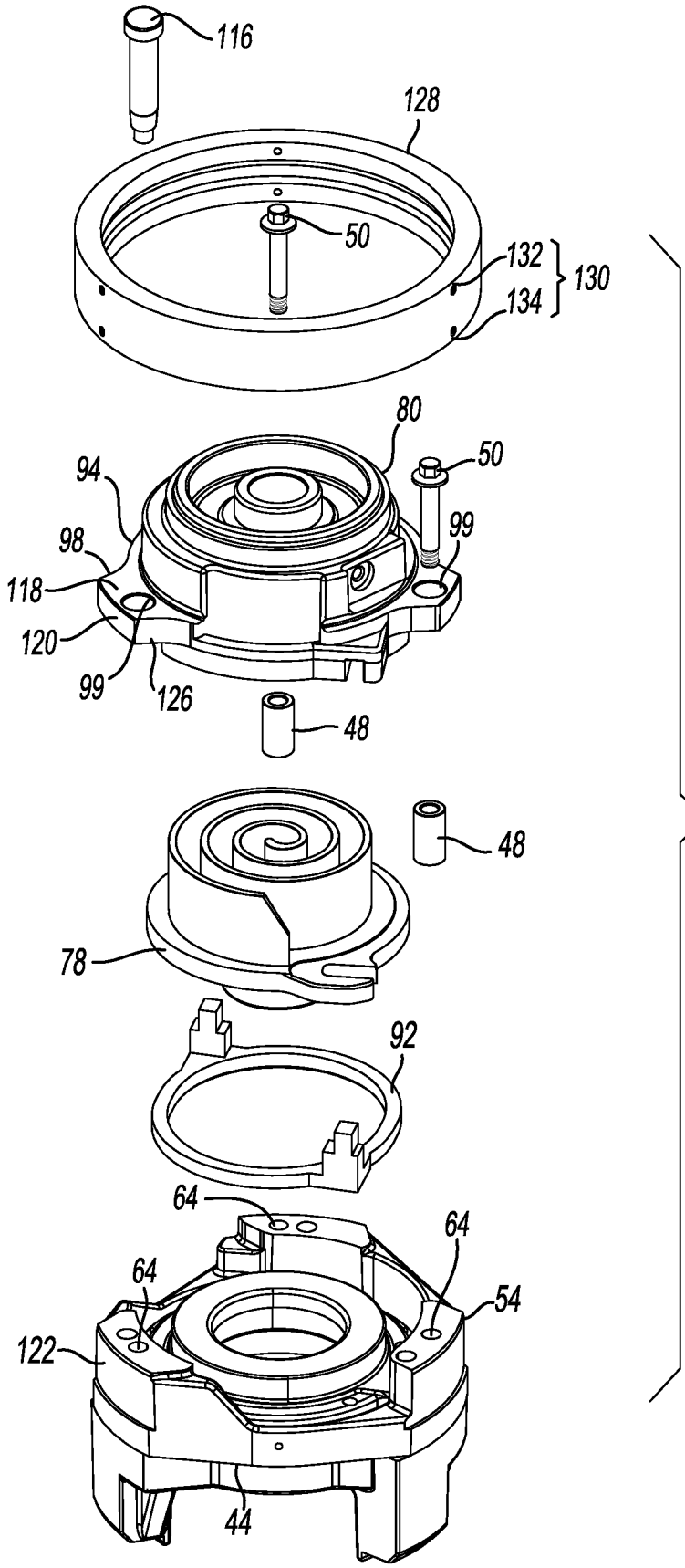
FIG. 5 is an exploded isometric view of a main bearing housing assembly, a compression mechanism, and an alignment assembly according to the present disclosure.
Figure 6:
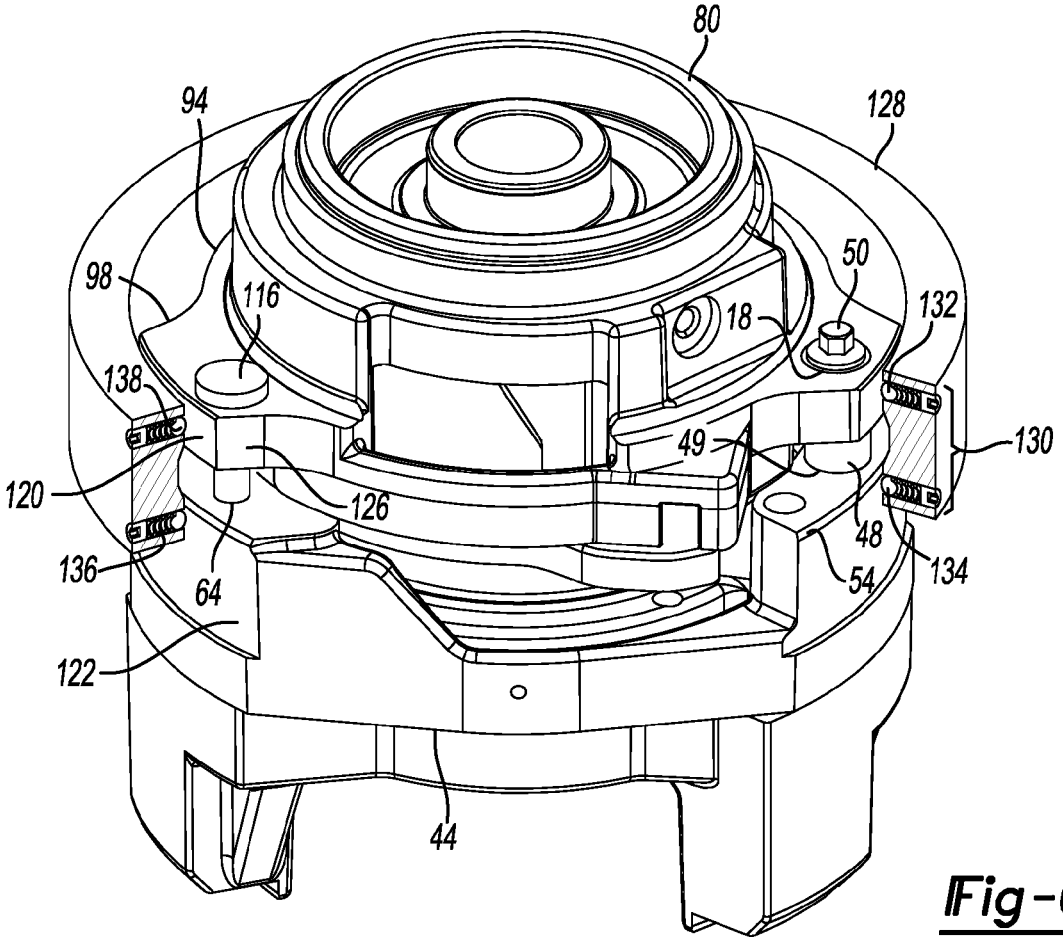
FIG. 6 is an isometric view of a main bearing housing assembly assembled to a compression mechanism and a sectioned isometric view of an alignment assembly according to the present disclosure.
Figure 7:
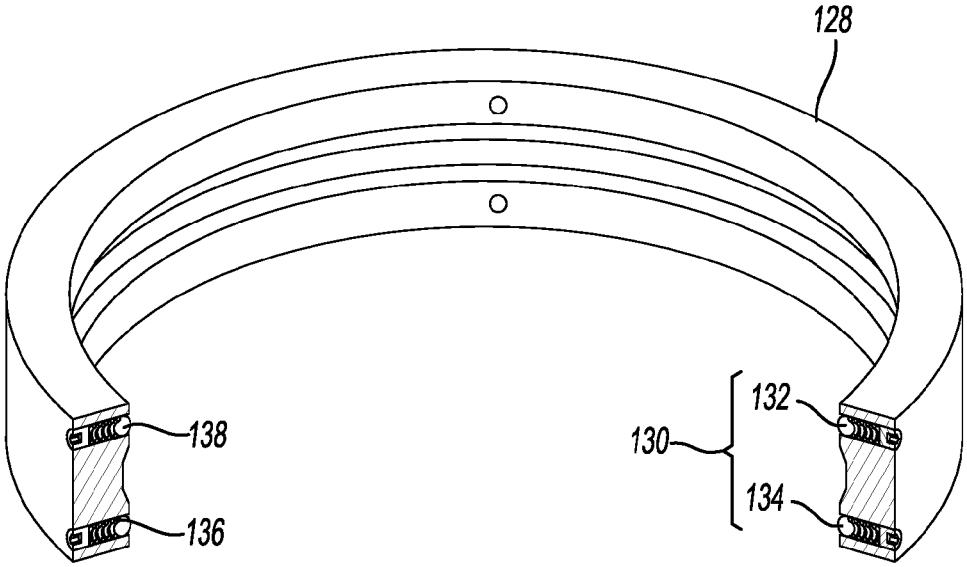
FIG. 7 is a sectioned isometric view of an alignment assembly according to the present disclosure.

With reference to FIGS. 5-7, in a second arrangement, a scroll alignment member 128 may concentrically align non-orbiting scroll 80 relative to main bearing housing 44 while accommodating increased variation in outer radial surfaces 120, 122. Scroll alignment member 128 may form a generally annular body and include a biasing mechanism 130. Biasing mechanism 130 may include upper biasing members 132 and lower biasing members 134. Upper biasing members 132 and lower biasing members 134 may each include springs 136 and balls 138.

Scroll alignment member 128 may form a concentric alignment assembly and surround outer radial surface 120 of non-orbiting scroll 80 and outer radial surface 122 of main bearing housing 44. Biasing mechanism 130 may extend radially inward relative to an inner wall of scroll alignment member 128 and abut outer radial surfaces 120, 122. Upper biasing members 132 may abut outer radial surface 120 of non-orbiting scroll 80. Lower biasing members 134 may abut outer radial surfaces 122 of main bearing housing 44.

Figure 8:
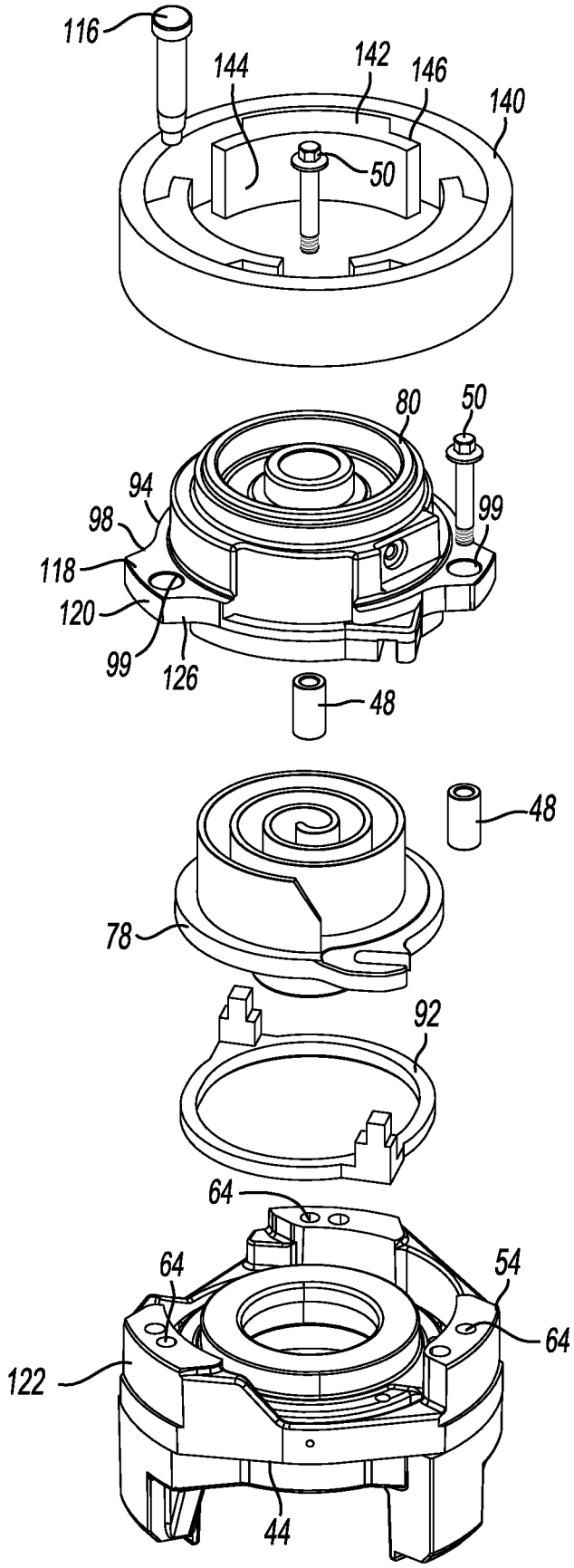
FIG. 8 is an exploded isometric view of a main bearing housing assembly, a compression mechanism, and an alignment assembly according to the present disclosure.
Figure 9:
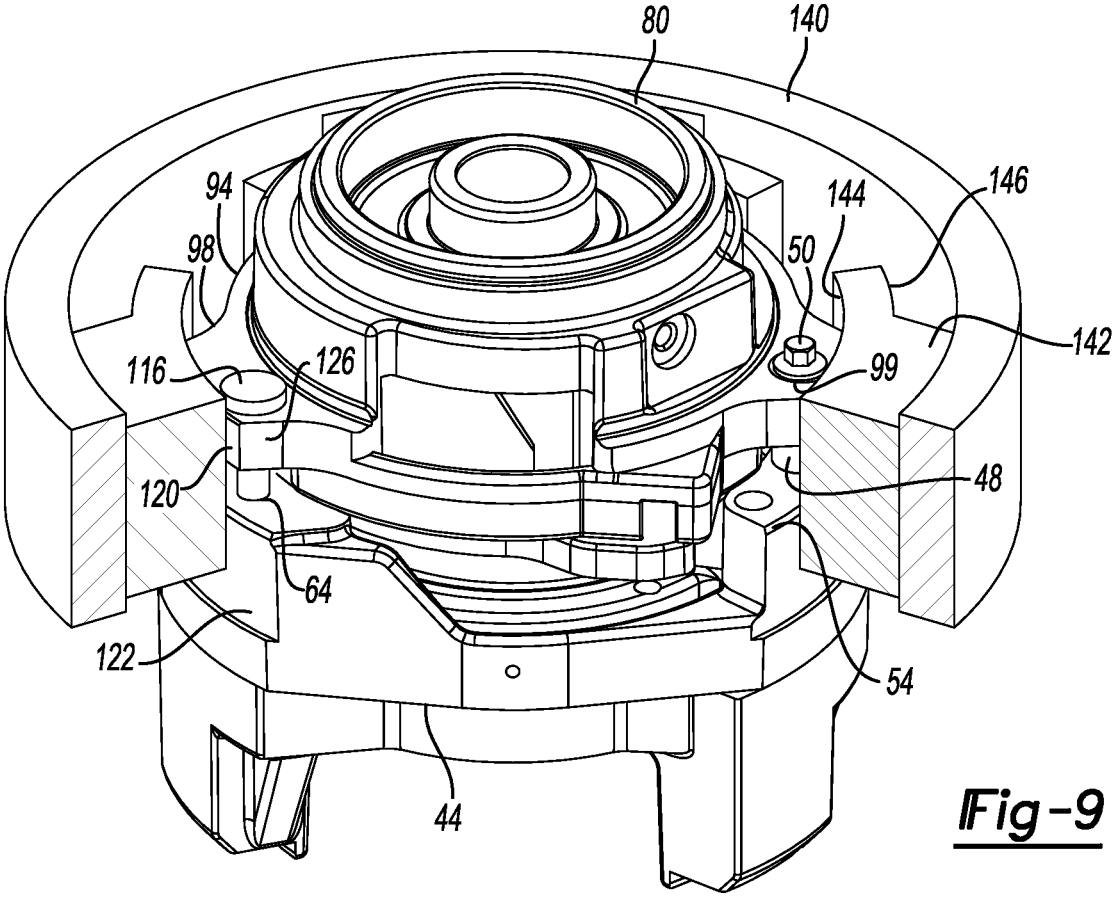
FIG. 9 is an isometric view of a main bearing housing assembly assembled to a compression mechanism and a sectioned isometric view of an alignment assembly according to the present disclosure.
Figure 10:
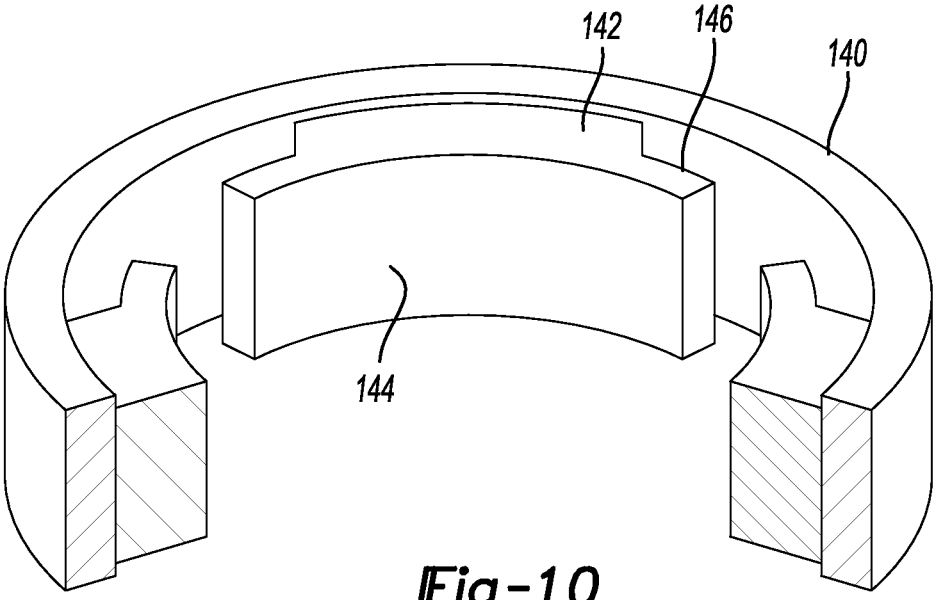
FIG. 10 is a sectioned isometric view of an alignment assembly according to the present disclosure.

With reference to FIGS. 8-10, in a third arrangement, a scroll alignment member includes an outer concentric alignment member 140 having inner concentric alignment members 142 extending radially inward therefrom. The outer and inner concentric alignment members 140, 142 may concentrically align non-orbiting scroll 80 relative to main bearing housing 44. Inner concentric alignment members 142 may form jaws including inner radial surfaces 144 and outwardly extending flange portions 146. Inner radial surfaces 144 abut outer radial surfaces 120, 122 to concentrically align non-orbiting scroll 80 relative to main bearing housing 44.

Figure 11:
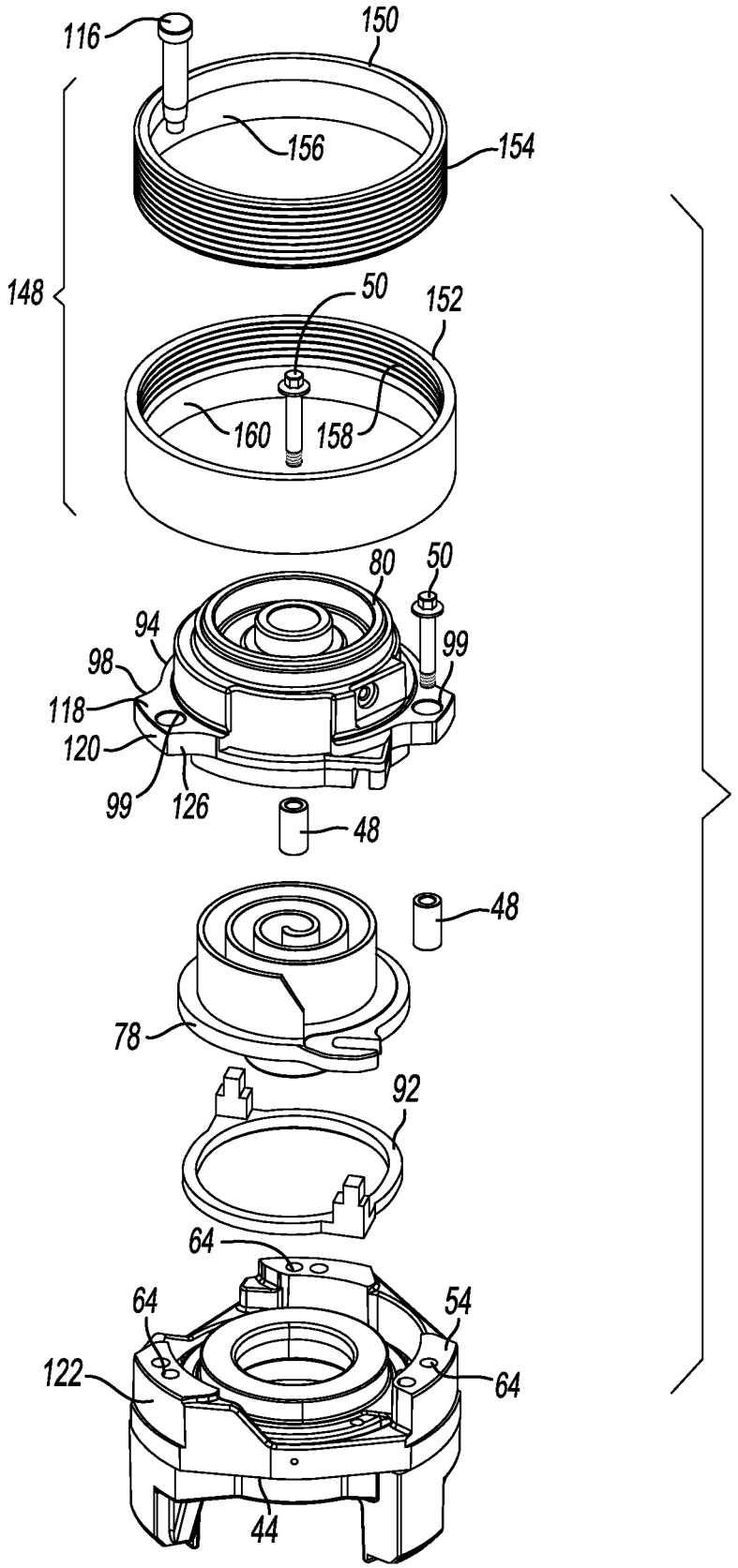
FIG. 11 is an exploded isometric view of a main bearing housing assembly, a compression mechanism, and an alignment assembly according to the present disclosure.
Figure 12:
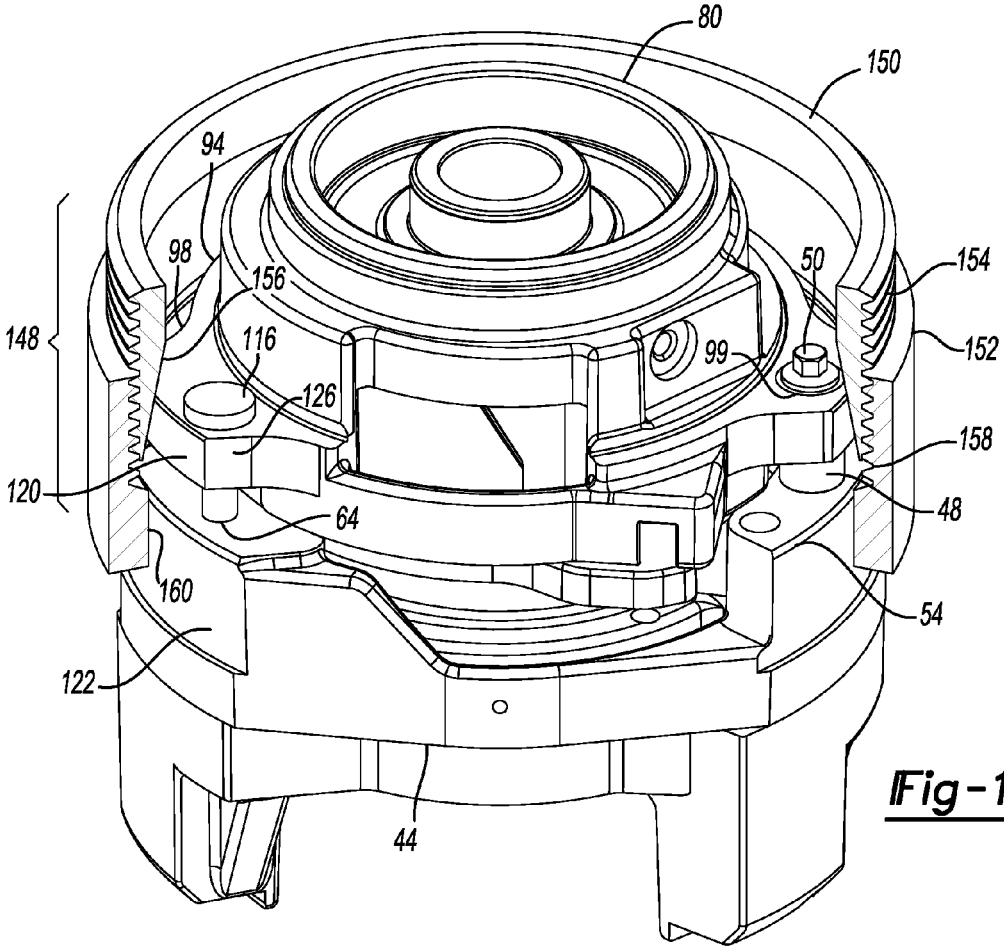
FIG. 12 is an isometric view of a main bearing housing assembly assembled to a compression mechanism and an sectioned isometric view of an alignment assembly according to the present disclosure.
Figure 13:
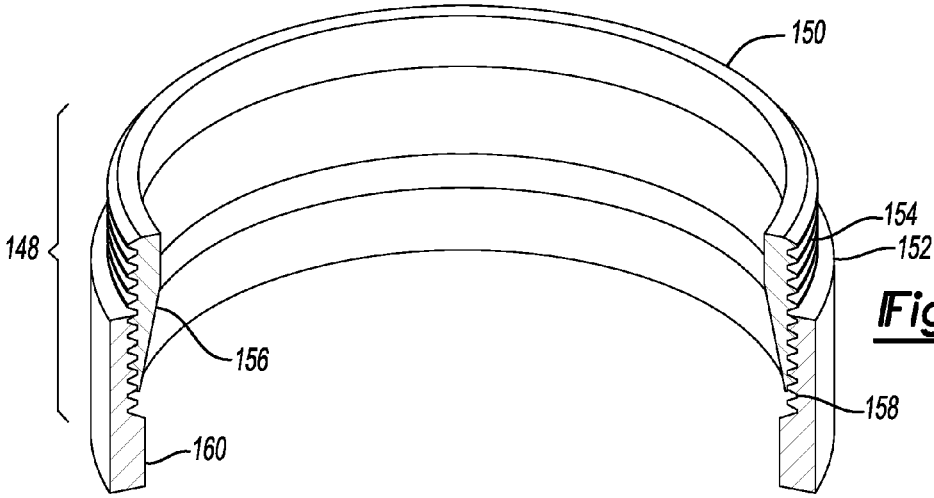
FIG. 13 is a sectioned isometric view of an alignment assembly according to the present disclosure.

With reference to FIGS. 11-13, in a fourth arrangement, a scroll alignment assembly 148 may concentrically align non-orbiting scroll 80 relative to main bearing housing 44. Scroll alignment assembly 148 includes upper threaded member 150 and lower threaded member 152. Upper threaded member 150 includes outer radial threads 154 and inner radial surface 156. Lower threaded member 152 includes inner radial threads 158 and inner radial surface 160.

Inner radial surface 160 of lower threaded member 152 abuts outer radial surface 122 of main bearing housing 44. Inner radial surface 160 may be tapered such that lower threaded member 152 is supported by main bearing housing 44. Inner radial surface 156 of upper threaded member 150 may be tapered such that inner radial surface 156 engages outer radial surface 120 of non-orbiting scroll 80 as outer radial threads 154 of upper threaded member 150 engage inner radial threads 158 of lower threaded member 152.

Figure 14:
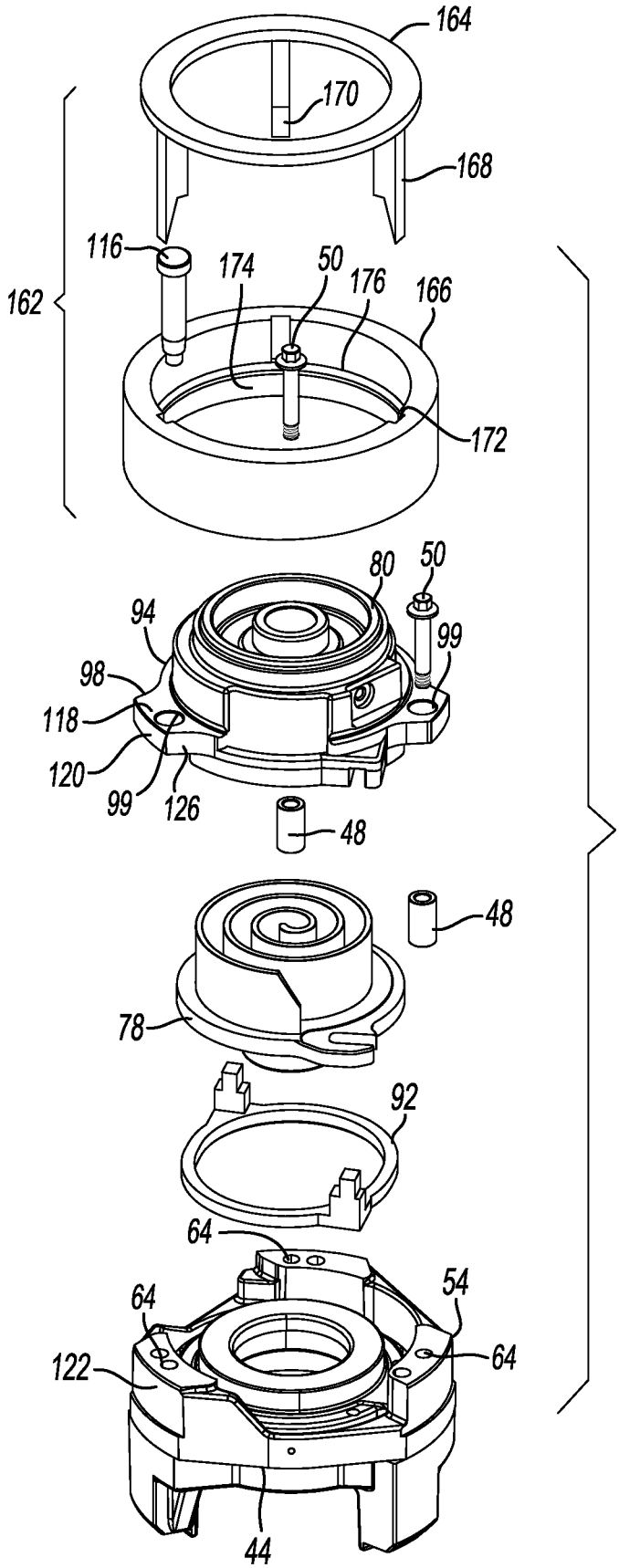
FIG. 14 is an exploded isometric view of a main bearing housing assembly, a compression mechanism, and an alignment assembly according to the present disclosure.
Figure 15:
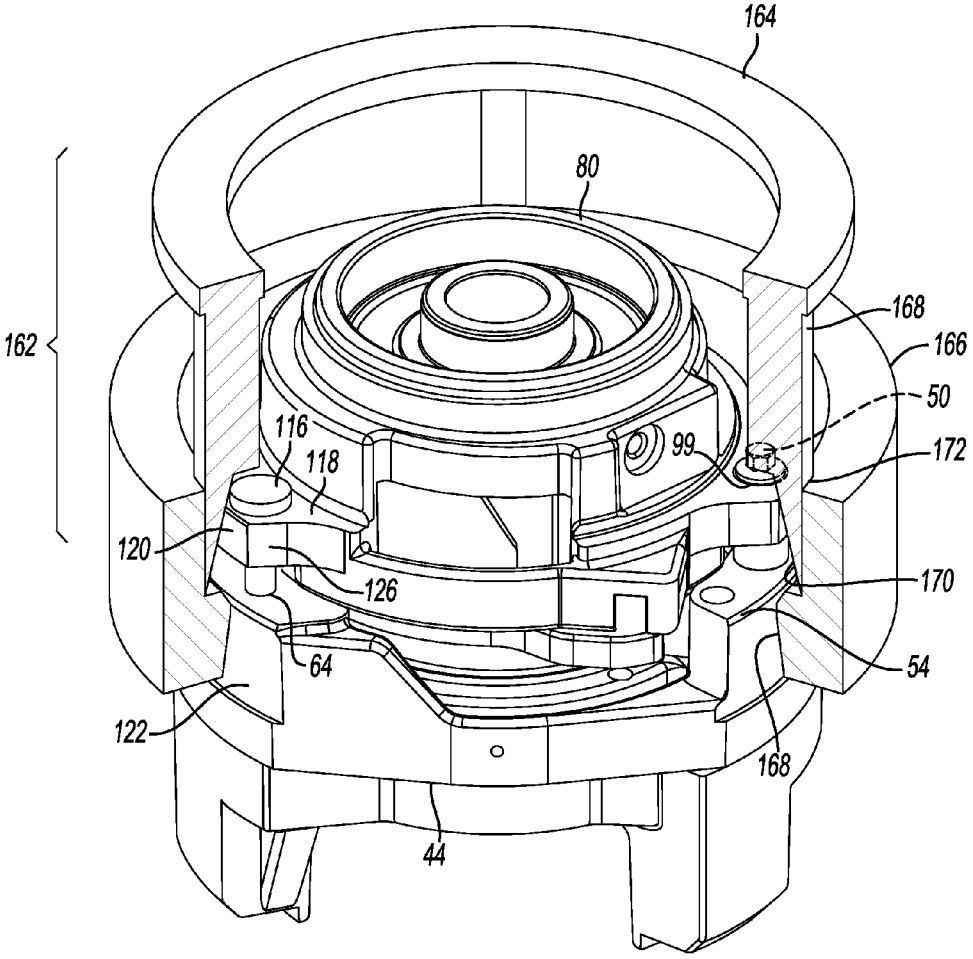
FIG. 15 is an isometric view of a main bearing housing assembly assembled to a compression mechanism and a sectioned isometric view of an alignment assembly according to the present disclosure.
Figure 16:
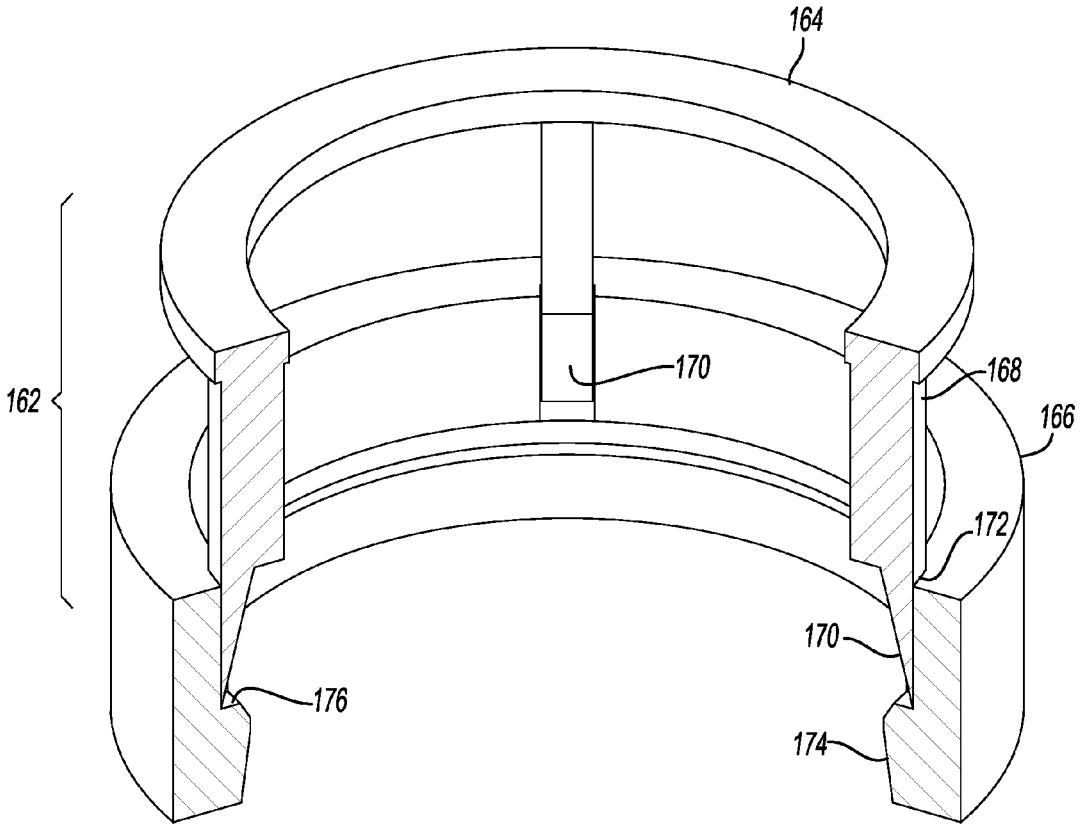
FIG. 16 is a sectioned isometric view of an alignment assembly according to the present disclosure.
Figure 17:
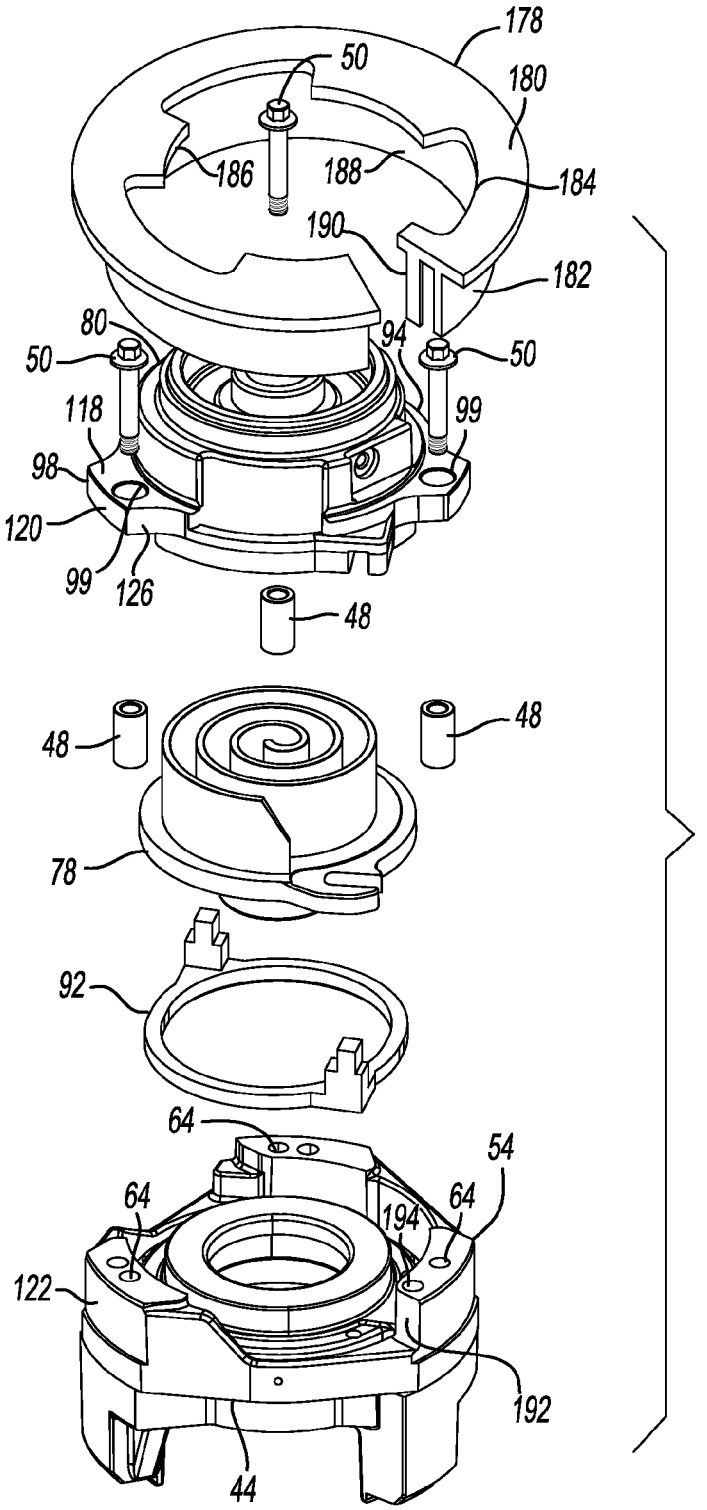
FIG. 17 is an exploded isometric view of a main bearing housing assembly, a compression mechanism, and an alignment assembly according to the present disclosure.
Figure 18:
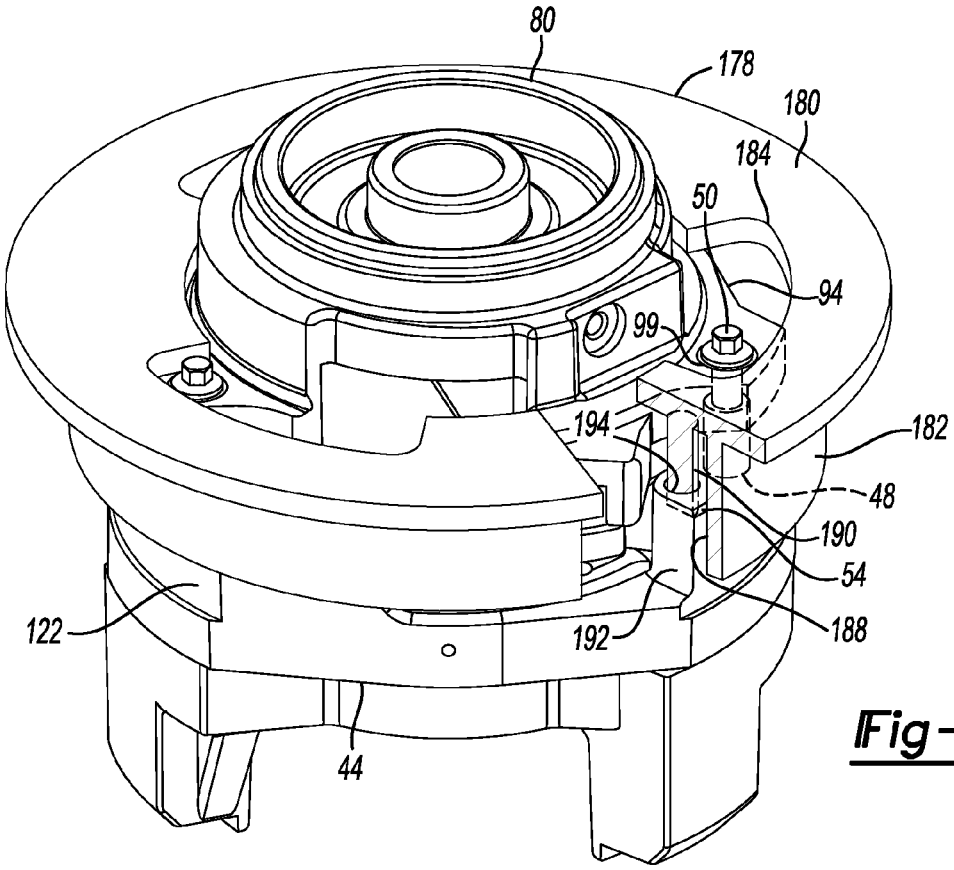
FIG. 18 is an isometric view of a main bearing housing assembly assembled to a compression mechanism and a sectioned isometric view of an alignment assembly according to the present disclosure.
Figure 19:
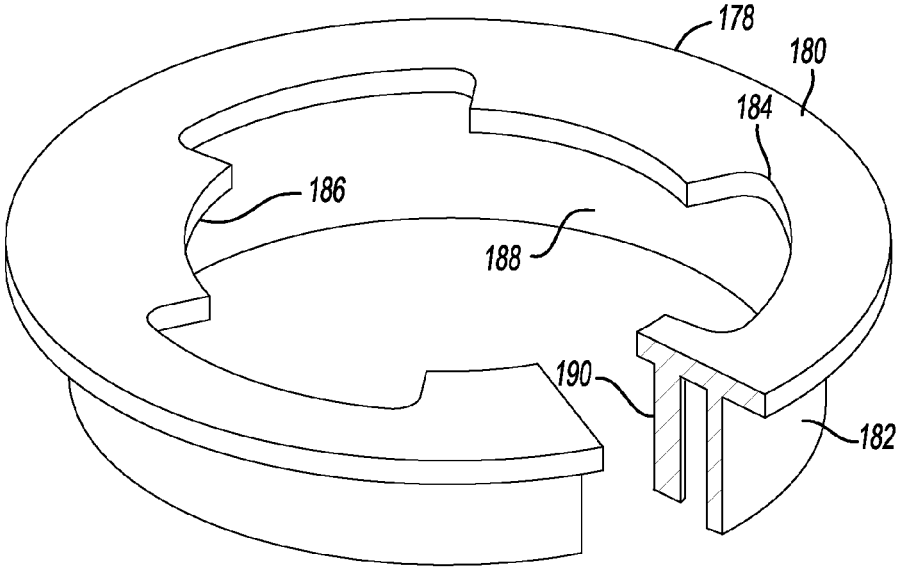
FIG. 19 is a sectioned isometric view of an alignment assembly according to the present disclosure.
Figure 20:
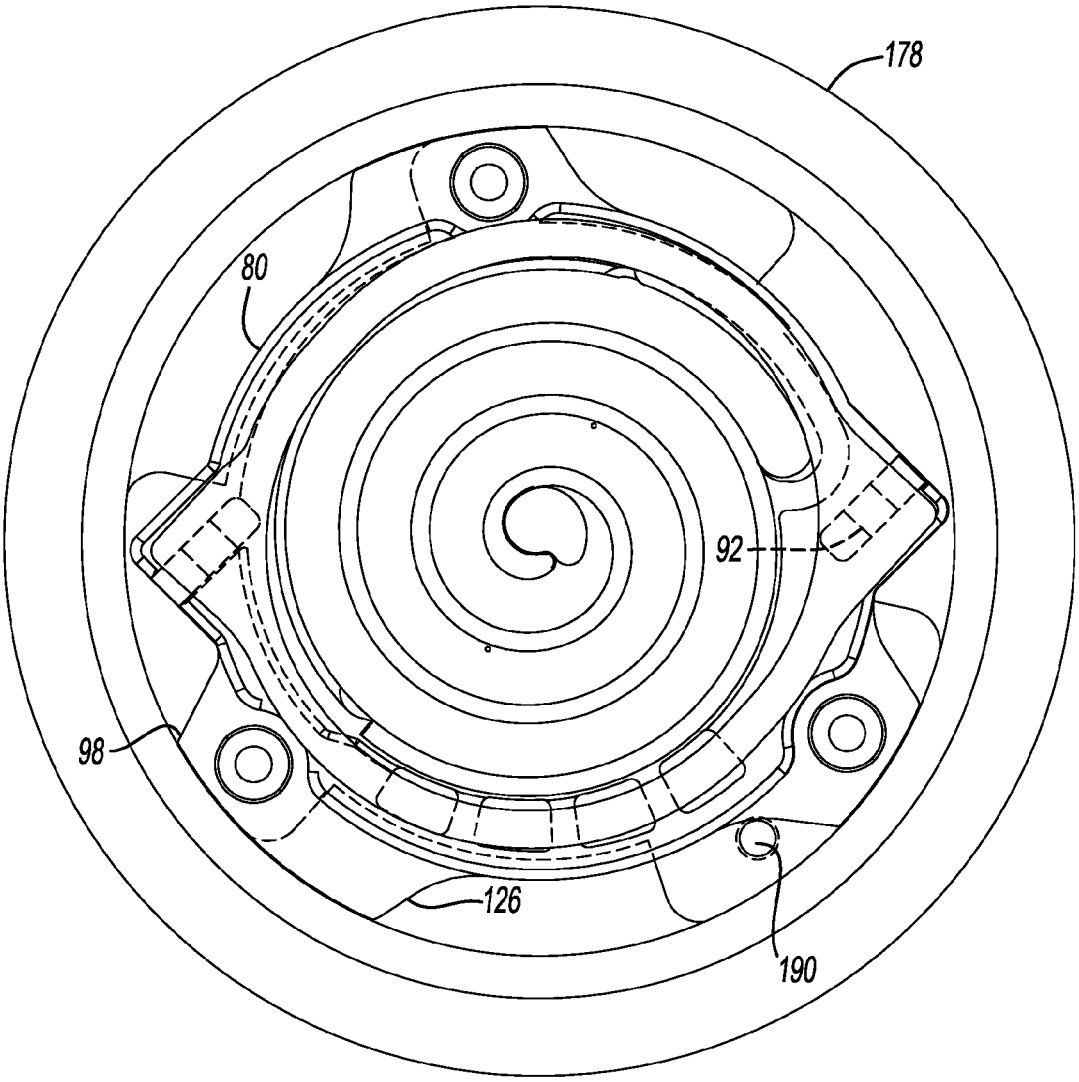
FIG. 20 is a bottom view of a main bearing housing assembly and a compression mechanism concentrically aligned and rotationally fixed by an alignment assembly according to the present disclosure.

With reference to FIGS. 14-16, in a fifth arrangement, a scroll alignment assembly 162 may concentrically align non-orbiting scroll 80 relative to main bearing housing 44. Scroll alignment assembly 162 includes an upper tapered member 164 and a lower tapered member 166. Upper tapered member 164 includes legs 168 having inner radial tapered surfaces 170. Lower tapered member 166 includes slots 172, an inner radial tapered surface 174, and an axial end surface 176.

Lower tapered member 166 may form a first concentric alignment assembly that surrounds outer radial surface 120 of non-orbiting scroll 80 and outer radial surface 122 of main bearing housing 44. Inner radial tapered surface 170 of upper tapered member 164 may abut outer radial surface 122 of main bearing housing 44 such that lower tapered member 166 is supported by main bearing housing 44. Legs 168 of upper tapered member 164 slide into slots 172 of lower tapered member 166 such that inner radial tapered surfaces 170 of legs 168 engage outer radial surfaces 120 of non-orbiting scroll 80.

With reference to FIGS. 17-20, in a sixth arrangement, a scroll alignment member 178 may concentrically align and rotationally fix non-orbiting scroll 80 relative to main bearing housing 44. The scroll alignment member 178 includes an axial alignment portion 180 and a concentric alignment portion 182. Axial alignment portion 180 may form a flat annular body. Concentric alignment portion 182 may form a generally annular body 188 and extend axially downward from axial alignment portion 180. Axial alignment portion 180 may include recesses 184 and an axial end surface 186. Recesses 184 may extend into an inner radial wall of axial alignment portion 180 to provide clearance for insertion of fasteners 50 to couple non-orbiting scroll 80 to main bearing housing 44. Scroll alignment member 178 may include a rotational stop member 190 extending axially downward from axial alignment portion 180.

Non-orbiting scroll 80 may be supported by main bearing housing 44 affixed to shell 28, with orbiting scroll 78 and Oldham coupling 92 located axially between main bearing housing 44 and non-orbiting scroll 80. Bushings 48 may be inserted into apertures 99 within end plate 94 of non-orbiting scroll 80. Axial alignment portion 180 may overlie and abut axial end surfaces 118 on end plate 94 of non-orbiting scroll 80 to axially locate scroll alignment member 178. Concentric alignment portion 182 may abut outer radial surfaces 120 on flanged portions 98 of non-orbiting scroll 80 and abut outer radial surfaces 122 on arms 54 of main bearing housing 44 to concentrically align non-orbiting scroll 80 relative to main bearing housing 44.

Rotational stop member 190 may abut one of outer radial surfaces 126 on flanged portions 98 of non-orbiting scroll 80 and abut an outer radial surface 192 on arms 54 of main bearing housing 44 to rotationally fix non-orbiting scroll 80 relative to main bearing housing 44. Alternatively, rotational stop member 190 may abut one of outer radial surfaces 126 on flanged portions 98 of non-orbiting scroll 80 and extend into an aperture 194 within arms 54 of main bearing housing 44 to rotationally fix non-orbiting scroll 80 relative to main bearing housing 44. All fasteners 50 may be assembled into apertures 64 in one operation since rotational stop member 190 utilizes outer radial surface 192 or aperture 194 rather than apertures 64 to rotationally fix non-orbiting scroll 80 relative to main bearing housing 44.

Figure 21:
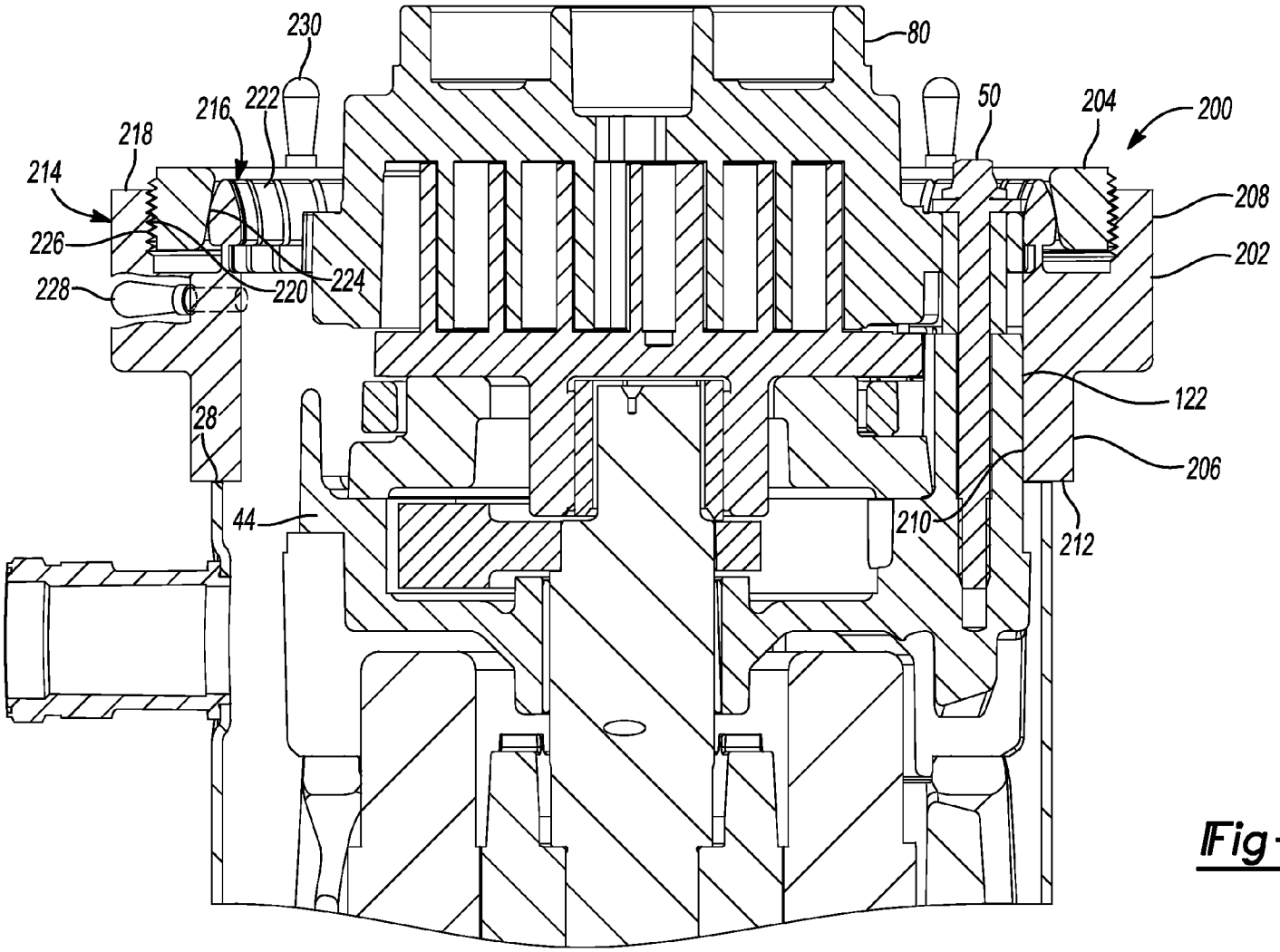
FIG. 21 is a fragmentary section view of an alternate alignment assembly according to the present disclosure.

With reference to FIG. 21, in a seventh arrangement, a scroll alignment assembly 200 may concentrically align non-orbiting scroll 80 relative to main bearing housing 44. Scroll alignment assembly 200 includes first and second members 202, 204. The first member 202 may include first and second portions 206, 208 axially offset from one another. The first portion 206 may define an inner radial surface 210 that abuts the outer radial surface 122 of the main bearing housing 44 and an axial end surface 212 that abuts an end of shell 28. The second portion 208 may include a radially outer region 214 and a radially inner region 216. The radially outer region 214 may define an annular wall 218 extending axially outward from the first portion 206 and defining a threaded inner radial surface 220. The radially inner region 216 may include a series of flexible arms 222 extending axially outward from the first portion 206.

The second member 204 may form an annular ring having a ramped inner radial surface 224 and a threaded outer radial surface 226. The second member 204 may be located radially between and axially aligned with the radially inner and outer regions 214, 216 of the first member 202. The ramped inner radial surface 224 of the second member 204 may be engaged with the flexible arms 222 of the first member 202 and may decrease in diameter in a direction axially outward relative to the flexible arms 222. The threaded outer radial surface 226 of the second member 204 may be engaged with the threaded inner radial surface 220 of the first member 202.

During assembly, the non-orbiting scroll 80 may be initially located relative the main bearing housing 44 by alignment pin 116. The first member 202 may be located on the compressor assembly 10 with the first portion 206 surrounding the main bearing housing 44 and abutting an end of shell 28 and with the flexible arms 222 of the second portion 208 surrounding the non-orbiting scroll 80. The first member 202 may be rotationally secured relative to the main bearing housing 44 via handle 228 and the second member 204 may be rotated via handle 230 to adjust the concentric alignment between the non-orbiting scroll 80 and the main bearing housing 44. Specifically, as the second member 204 is rotated to displace the second member 204 toward the main bearing housing 44, the ramped inner radial surface 224 of the second member 204 engages the flexible arms 222 of the first member 202 and displaces the flexible arms 222 radially inward and into engagement with the non-orbiting scroll 80 and concentrically aligns the non-orbiting scroll 80 and the main bearing housing 44. The fasteners 50 may then be inserted to fix the non-orbiting scroll 80 relative to the main bearing housing 44.

Figure 22:
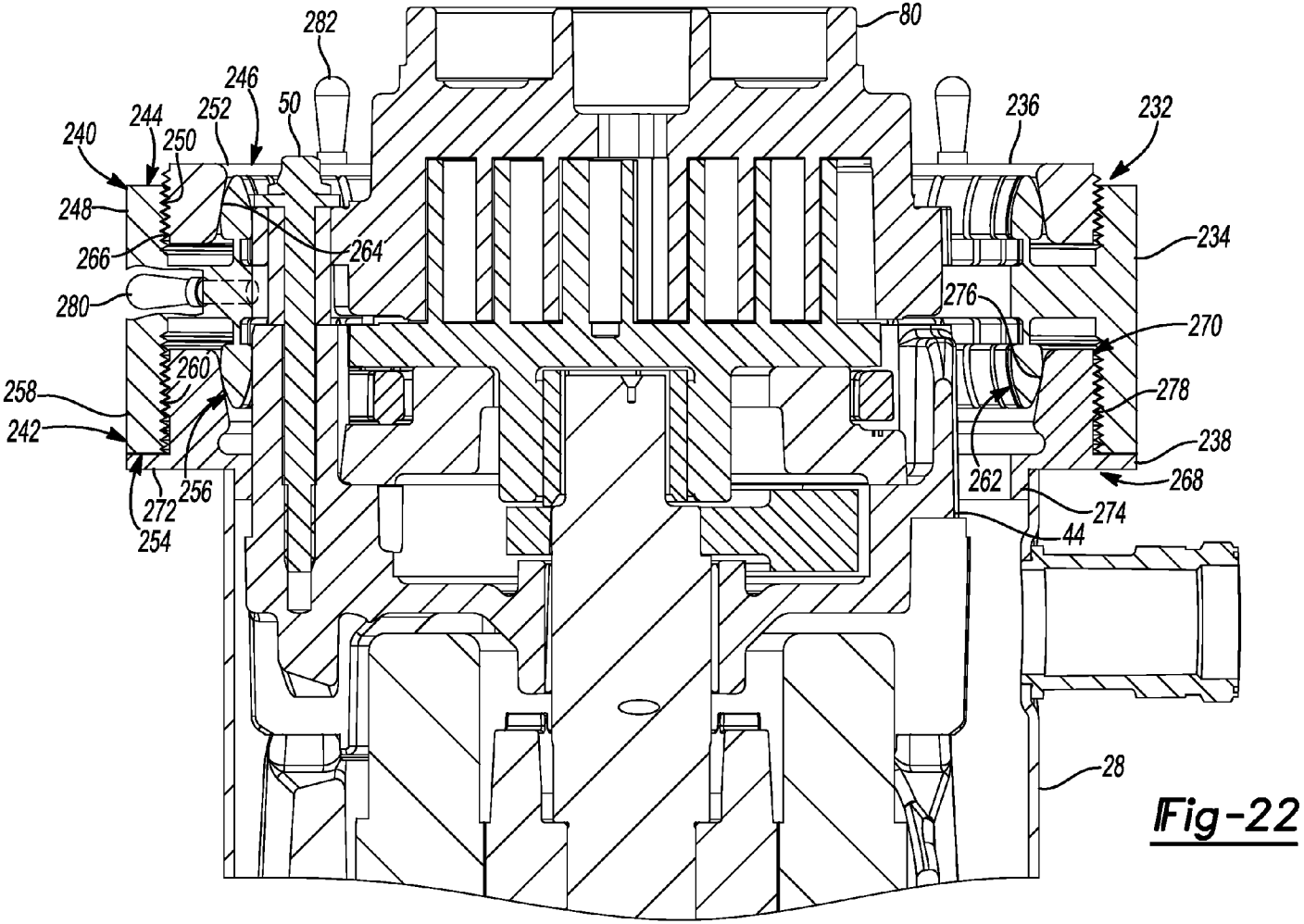
FIG. 22 is a fragmentary section view of an alternate alignment assembly according to the present disclosure.

With reference to FIG. 22, in an eighth arrangement, a scroll alignment assembly 232 may concentrically align non-orbiting scroll 80 relative to main bearing housing 44. The alignment assembly 232 may include first, second and third members 234, 236, 238. The first member 234 may include first and second portions 240, 242 axially offset from one another. The first portion 240 may include a first radially outer region 244 and a first radially inner region 246. The first radially outer region 244 may define a first annular wall 248 extending axially outward from the second portion 242 and defining a first threaded inner radial surface 250. The first radially inner region 246 may include a first series of flexible arms 252 extending axially outward from the first portion 240. The second portion 242 may include a second radially outer region 254 and a second radially inner region 256. The second radially outer region 254 may define a second annular wall 258 extending axially outward from the first portion 240 and defining a second threaded inner radial surface 260. The second radially inner region 256 may include a second series of flexible arms 262 extending axially outward from the first flexible arms 252.

The second member 236 may form an annular ring having a ramped inner radial surface 264 and a threaded outer radial surface 266. The second member 236 may be located radially between and axially aligned with the first radially outer and inner regions 244, 246 of the first member 234. The ramped inner radial surface 264 of the second member 236 may be engaged with the first flexible arms 252 of the first member 234 and may decrease in diameter in a direction axially outward relative to the first flexible arms 252. The threaded outer radial surface 266 of the second member 236 may be engaged with the threaded inner radial surface 250 of the first member 234.

The third member 238 may include a first portion 268 and a second portion 270 extending axially outward from the first portion 268. The first portion 268 may include a radially extending region 272 abutting the an end of the shell 28 and an axially extending portion 274 extending axially outward from the second portion 270 and surrounding the main bearing housing 44. The second portion 270 may form an annular wall extending axially from the radially extending region 272 and having a ramped inner radial surface 276 and a threaded outer radial surface 278. The third member 238 may be located radially between and axially aligned with the second radially outer and inner regions 254, 256 of the first member 234. The ramped inner radial surface 276 of the third member 238 may be engaged with the second flexible arms 262 of the first member 234 and may decrease in diameter in a direction axially outward relative to the second flexible arms 262. The second threaded outer radial surface 278 of the third member 238 may be engaged with the second threaded inner radial surface 260 of the first member 234.

During assembly, the first, second and third members 234, 236, 238 may be located on the compressor assembly 10. Similar to the arrangement of FIG. 21 described above, the non-orbiting scroll 80 may be initially located relative the main bearing housing 44 by alignment pin 116 and the first and second flexible arms 252, 262 may concentrically align the non-orbiting scroll 80 relative to the main bearing housing 44. More specifically, the third member 238 may be rotationally secured relative to the main bearing housing 44 and the first member 234 may be rotated via handle 280 to adjust the concentric alignment between the first member 234 and the main bearing housing 44.

As the first member 234 is rotated, the second flexible arms 262 are displaced radially inward by ramped inner radial surface 276 and into engagement with the outer radial surface 122 of the main bearing housing 44. Similarly, as the second member 236 is rotated via handle 282, the ramped inner radial surface 264 of the second member 236 engages the first flexible arms 252 and displaces the first flexible arms 252 radially inward and into engagement with the non-orbiting scroll 80 and concentrically aligns the non-orbiting scroll 80 and the main bearing housing 44. The fasteners 50 may then be inserted to fix the non-orbiting scroll 80 relative to the main bearing housing 44.

What is claimed is:

1. A method comprising:

locating a first scroll member on a bearing housing of a compressor having a second scroll member located axially between the first scroll member and the bearing housing;

concentrically aligning the bearing housing and the first scroll member by engaging a first outer radial surface on the bearing housing and a second outer radial surface on the first scroll member with a first threaded member and a second threaded member by rotating the first threaded member relative to the second threaded member to engage at least one of the first and second outer radial surfaces; and coupling the first scroll member relative to the bearing housing.

2. The method of claim 1, further comprising aligning a first aperture in the first scroll member and a second aperture in the bearing housing with an alignment pin to rotationally locate the first scroll member relative to the bearing housing.

3. The method of claim 2, wherein said aligning includes using a single alignment pin.

4. The method of claim 1, wherein at least one of the first and second threaded members includes a tapered inner surface, said engaging including the tapered inner surface engaging at least one of the first and second outer radial surfaces to provide concentric alignment between the first scroll member and the bearing housing.

5. The method of claim 1, wherein the first threaded member includes axially extending first flexible arms adjacent to the second outer radial surface on the first scroll member and the second threaded member includes a first ramped surface located radially outward relative to the first flexible arms, said concentrically aligning including the first ramped surface displacing the first flexible arms radially inward and into engagement with the second outer radial surface on the first scroll member.

6. The method of claim 5, wherein the first threaded member includes a first annular wall located radially outward from the first flexible arms and defining a first threaded inner surface, the second threaded member defining a first threaded outer surface engaged with the first threaded inner surface and said concentrically aligning including rotating the second threaded member relative to the first threaded member to displace the first flexible arms.

7. The method of claim 6, wherein the first threaded member includes axially extending second flexible arms extending opposite the first flexible arms and adjacent to the first outer radial surface on the bearing housing, and a third threaded member includes a second ramped surface located radially outward relative to the second flexible arms, wherein said concentrically aligning includes the second ramped surface displacing the second flexible arms radially inward and into engagement with the first outer radial surface on the bearing housing.

8. The method of claim 7, further comprising locating the third threaded member on an end of a compressor shell containing the bearing housing.

9. The method of claim 7, wherein the third threaded member includes a second annular wall located radially outward from the second flexible arms and defining a second threaded inner surface, the second threaded member defining a second threaded outer surface engaged with the second threaded inner surface and said concentrically aligning including rotating the first threaded member relative to the third threaded member to displace the second flexible arms.

10. A scroll alignment assembly comprising:

a first threaded member that circumferentially overlies a bearing housing of a compressor; and a second threaded member threadingly engaged, and concentrically aligned, with said first threaded member to concentrically align a first scroll member relative to the bearing housing.

11. The scroll alignment assembly of claim 10, wherein said second threaded member engages a first outer radial surface on the first scroll member to concentrically align the first scroll member relative to the bearing housing.

12. The scroll alignment assembly of claim 10, wherein an inner radial portion of said first threaded member is threadingly engaged with an outer radial portion of said second threaded member.

13. The scroll alignment assembly of claim 10, wherein a first inner radial surface of said first threaded member is abutting an outer radial surface of said bearing housing.

14. The scroll alignment assembly of claim 13, wherein said first inner radial surface is a tapered surface.

15. The scroll alignment assembly of claim 10, wherein a second inner radial surface of said second threaded member is abutting an outer radial surface of said first scroll member.

16. The scroll alignment assembly of claim 15, wherein said second inner radial surface is a tapered surface.

* * * * *